US007278636B2

(12) United States Patent
Zajac et al.

(10) Patent No.: US 7,278,636 B2
(45) Date of Patent: Oct. 9, 2007

(54) METHOD AND APPARATUS FOR PLAYING A DICE GAME

(76) Inventors: John D. Zajac, 9046 S. Delaware Dr., Oak Creek, WI (US) 53154; Michael R. Colen, 1440 Janet St., Sycamore, IL (US) 60178

( * ) Notice: Subject to any disclaimer, the term of this patent is extended or adjusted under 35 U.S.C. 154(b) by 288 days.

(21) Appl. No.: 11/017,195

(22) Filed: Dec. 20, 2004

(65) Prior Publication Data

US 2005/0151317 A1 Jul. 14, 2005

Related U.S. Application Data

(60) Provisional application No. 60/531,097, filed on Dec. 19, 2003.

(51) Int. Cl.
*A63F 9/06* (2006.01)

(52) U.S. Cl. ..... 273/146

(58) Field of Classification Search ..... 273/146
See application file for complete search history.

(56) References Cited

U.S. PATENT DOCUMENTS 3,909,002 A * 9/1975 Levy ..... 463/26
3,929,337 A * 12/1975 Hayes ..... 273/243
4,469,329 A * 9/1984 Guyer ..... 273/146
5,405,145 A * 4/1995 Jones et al. ..... 273/146
5,505,457 A * 4/1996 Boylan et al. ..... 273/274
5,676,375 A * 10/1997 Pirouzkhah ..... 273/274
5,791,651 A * 8/1998 Bryant ..... 273/274
6,123,333 A * 9/2000 McGinnis et al. ..... 273/146
6,173,955 B1 * 1/2001 Perrie et al. ..... 273/146
6,234,482 B1 * 5/2001 Henderson ..... 273/274
6,273,423 B1 * 8/2001 Promutico ..... 273/274
6,336,633 B1 * 1/2002 Webb ..... 273/274
6,508,469 B2 * 1/2003 Promutico ..... 273/274
6,746,016 B2 * 6/2004 Perrie et al. ..... 273/138.1
6,932,340 B1 * 8/2005 Schaefer et al. ..... 273/146
7,032,901 B2 * 4/2006 Perrie et al. ..... 273/138.1
2002/0163127 A1 * 11/2002 Perrie et al. ..... 273/274
2004/0251629 A1 * 12/2004 Oliva ..... 273/274
2005/0046107 A1 * 3/2005 Guyer et al. ..... 273/146
2005/0184456 A1 * 8/2005 Lowery ..... 273/146

* cited by examiner

*Primary Examiner*—Eugene Kim
*Assistant Examiner*—Dolores R. Collins
(74) *Attorney, Agent, or Firm*—Andrus, Sceales, Starke & Sawall, LLP

(57) ABSTRACT

The method and apparatus for playing a dice game of the present invention includes a casino table covered with a felt, the felt having the necessary game areas printed on it, seven standard six-sided dice and a dice cup, wherein one of the seven standard six-sided dice is the dealer die, which is a different color than the other six. The method and apparatus further includes utilizing the apparatus by rolling the dealer die to determine the dealer's number and then wagering on which of the remaining numbers from 1-6 is rolled again or before the end of six rolls. The method and apparatus further includes a "double hit" option of wagering if a player wins in the first round.

6 Claims, 4 Drawing Sheets

METHOD AND APPARATUS FOR PLAYING A DICE GAME

RELATED APPLICATIONS

This application claims priority under 35 U.S.C. § 119 of the U.S. provisional application 60/531,097, filed on Dec. 19, 2003 and entitled "SIMPLER AND EXCITING DICE GAME." The provisional application 60/531,097, and entitled "SIMPLER AND EXCITING DICE GAME" is also hereby incorporated by reference.

FIELD OF THE INVENTION

The present invention relates to the field casino games. More specifically, the invention relates to the field of casino dice games.

BACKGROUND OF THE INVENTION

Typically, the casino game industry includes various games from slots to table games. Among the table games, there are many options of different card games available to play, including Blackjack, Caribbean Stud, Let It Ride and War. Each varying in the amount of strategy required, as well as the ease or difficulty of playing the game. In addition, there are some dice games available, the most popular being Craps.

The main problem with these conventional casino games are that they are very confusing for most players to understand. For instance, Craps is very intimidating and confusing for many people to play due to the unusual odds involved, as well as the complex set of rules, e.g., on the initial roll a 7 roll wins and afterwards it loses. Because of these problems, there are many gamblers who have grown up playing dice games and enjoy them, but do not have a dice game that is less intimidating available in the casino for them to play.

Another problem with conventional casino games is that the sit down table games that are currently available, such as Blackjack or Pai Gow Poker, have a limited number of spaces for wagers at each table. Most of the sit down table games have spots for 6 or 7 players. If a player wishes to increase the excitement level by playing more than one wager, they need to take up an additional betting circle, thus eliminating a spot for another player to sit down. In addition, some games such as Caribbean Stud or Let It Ride will only allow one bet, per person, per table.

Another problem with conventional casino games is that many of the table games such as Blackjack require numerous strategic decisions during the game which forces a player to study, practice and memorize the proper strategic play in order to lower the casino advantage to its minimum levels. Many players do not know the proper strategy and thus feel intimidated to play or feel they will lose large amounts of money so they choose not to play the game.

While these current casino games may be suitable for the particular purpose to which they address, they are not as suitable for casinos to use in order to provide a game of chance for gamblers, that gives the casino a slight statistical edge to generate revenue, while at the same time proves gamblers a dice game which is much easier to learn than craps, has simpler strategy than Blackjack, allows gamblers the opportunity to increase winnings with a unique payoff structure which increases as the game continues, and provides an exciting sit down dice game for gamblers in which each roll increases the excitement.

SUMMARY OF THE INVENTION

The method and apparatus for playing a dice game of the present invention includes a casino table covered with a felt, the felt having the necessary game areas printed on it, seven standard six-sided dice and a dice cup, wherein one of the seven standard six-sided dice is the dealer die, which is a different color than the other six. The method and apparatus further includes utilizing the apparatus by rolling the dealer die to determine the dealer's number and then wagering on which of the remaining numbers from 1-6 is rolled again or before the end of six rolls. The method and apparatus further includes a "double hit" option of wagering if a player wins in the first round.

In one aspect of the present invention, a method for playing a dice game comprises determining a dealer's number by rolling a dealer's die, placing a wager on a wager number, wherein the wager number is selected from one of the numbers on a game die, further wherein the wager number is not the same as the dealer's number, determining a first game number by rolling a game die, comparing the first game number to the wager number, wherein when the first game number is the same as the wager number, the player wins a single hit payout, the single hit payout including the wager multiplied by a predetermined single hit factor, and further wherein when the dice game is in a first round, the player is given a choice between collecting the single hit payout or making a double hit wager.

The method also includes determining a second game number by rolling the game die, wherein when the second game number is the same as the wager number, the player wins the single hit payout, further wherein when the player chooses to make the double hit wager and the second game number is the same as the wager number, the player wins a double hit payout, the double hit payout including the wager multiplied by a predetermined double hit factor, and comparing the first game number and the second game number to the dealer number, wherein when either one of the first game number or second game number is the same as the dealer number, the dice game ends, wherein the dice game includes a predetermined number of rounds including a corresponding number of potential game numbers, further wherein the dice game ends after the predetermined number of rounds.

The method further comprises marking the dealer's number on a dice marker with a dealer's number lammer, marking the first game number on the dice marker with a game number lammer, marking the second game number on the dice marker with the game number lammer, placing the single hit payout in a single hit payout area, wherein the single hit payout is collected by the player when the dice game ends, placing a double hit wager lammer on the wager when the player chooses to make the double hit wager, and placing the double hit payout in a double hit payout area, wherein the double hit payout is collected by the player when the dice game ends, further wherein the single hit factor and the double hit factor are variable values that depend on which one of the predetermined number of rounds is currently being played.

In another aspect of the present invention, an apparatus for playing a casino game comprises means for determining a dealer's number, means for placing a wager on a wager number, wherein the wager number is selected from a set of predetermined numbers, further wherein the wager number is not the same as the dealer's number, means for determining a first game number, means for comparing the first game number to the wager number, wherein when the first game number is the same as the wager number, the player wins a single hit payout, the single hit payout including the wager multiplied by a predetermined single hit factor, and further wherein when the dice game is in a first round, the player is given a choice between collecting the single hit payout or making a double hit wager.

The apparatus also includes means for determining a second game number, wherein when the second game number is the same as the wager number, the player wins the single hit payout, further wherein when the player chooses to make the double hit wager and the second game number is the same as the wager number, the player wins a double hit payout, the double hit payout including the wager multiplied by a predetermined double hit factor, and means for comparing the first game number and the second game number to the dealer number, wherein when either one of the first game number or second game number is the same as the dealer number, the casino game ends, wherein the casino game includes a predetermined number of rounds including a corresponding number of potential game numbers, further wherein the casino game ends after the predetermined number of rounds.

The apparatus further comprises means for marking the dealer's number on a number marker, means for marking the first game number on the number marker, means for marking the second game number on the number marker, means for placing the single hit payout in a single hit payout area, wherein the single hit payout is collected by the player when the casino game ends, means for marking the wager when the player chooses to make the double hit wager, and means for placing the double hit payout in a double hit payout area, wherein the double hit payout is collected by the player when the casino game ends, further wherein the single hit factor and the double hit factor are variable values that depend on which one of the predetermined number of rounds is currently being played.

In yet another aspect of the present invention, an apparatus for playing a dice game comprises a felt having a player area, wherein the player area includes a betting area, a single hit payout area, a double hit payout area and a double hit collection area, a dealer die, wherein the dealer die is rolled to determine a dealer's number, a plurality of betting spots configured in the betting area, wherein the plurality of betting spots have numbers corresponding to the sides of the dealer die, and further wherein a wager is placed on any of the betting spots other than the betting spot having the same number as the dealer's number, and a game die, wherein the game die is rolled to determine a first game number, further wherein the first game number is compared to the wager number, wherein when the first game number is the same as the betting spot, the player wins a single hit payout and the single hit payout is placed in the single hit payout area, the single hit payout including the wager multiplied by a predetermined single hit factor, and further wherein when the dice game is in a first round, the player is given a choice between collecting the single hit payout from the single hit payout area or making a double hit wager, wherein a second game number is determined by rolling the game die, wherein when the second game number is the same as the wager number, the player wins the single hit payout and the single hit payout is placed in the single hit payout area, further wherein when the player chooses to make the double hit wager and the second game number is the same as the wager number, the player wins a double hit payout and the double hit payout is placed in the single hit payout area, the double hit payout including the wager multiplied by a predetermined double hit factor.

When either one of the first game number or second game number is the same as the dealer number, the dice game ends, and wherein the dice game includes a predetermined number of rounds including a corresponding number of potential game numbers, further wherein the dice game ends after the predetermined number of rounds. The apparatus further comprises a dice marker having a plurality of marking spaces corresponding to the sides of the dealer's die, a game number lammer for marking the first game number and the second game number on the dice marker, a dealer's number lammer for marking the dealer's number on the dice marker, wherein the single hit payout is collected by the player when the dice game ends.

The apparatus further comprises a double hit wager lammer for marking the wager when the player chooses to make the double hit wager, wherein the double hit payout is collected by the player when the dice game ends, and further wherein the single hit factor and the double hit factor are variable values that depend on which one of the predetermined number of rounds is currently being played.

DETAILED DESCRIPTION OF THE INVENTION

The attached figures illustrate embodiments of the present invention, which is implemented with a casino table, where the players sit. The table has a felt 100 (FIG. 1) with the betting instructions listed and player areas 102 to place bets and for dealers to move a player's wager to a single hit payout area 106 or a double hit payout area 108 when the player has won.

Figure 1:
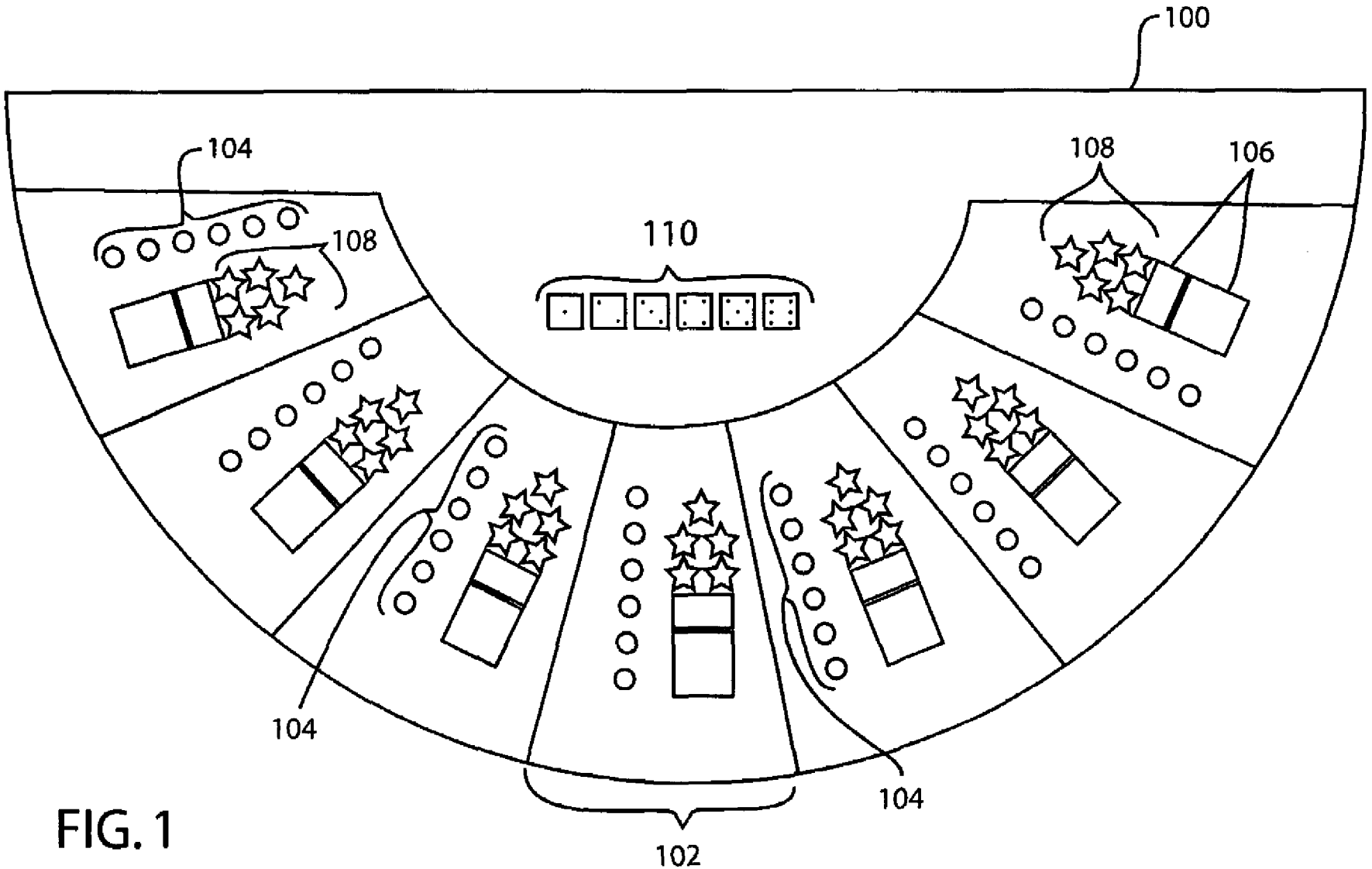
FIG. 1 is an illustration of the felt of an embodiment of the present invention.
Figure 2:
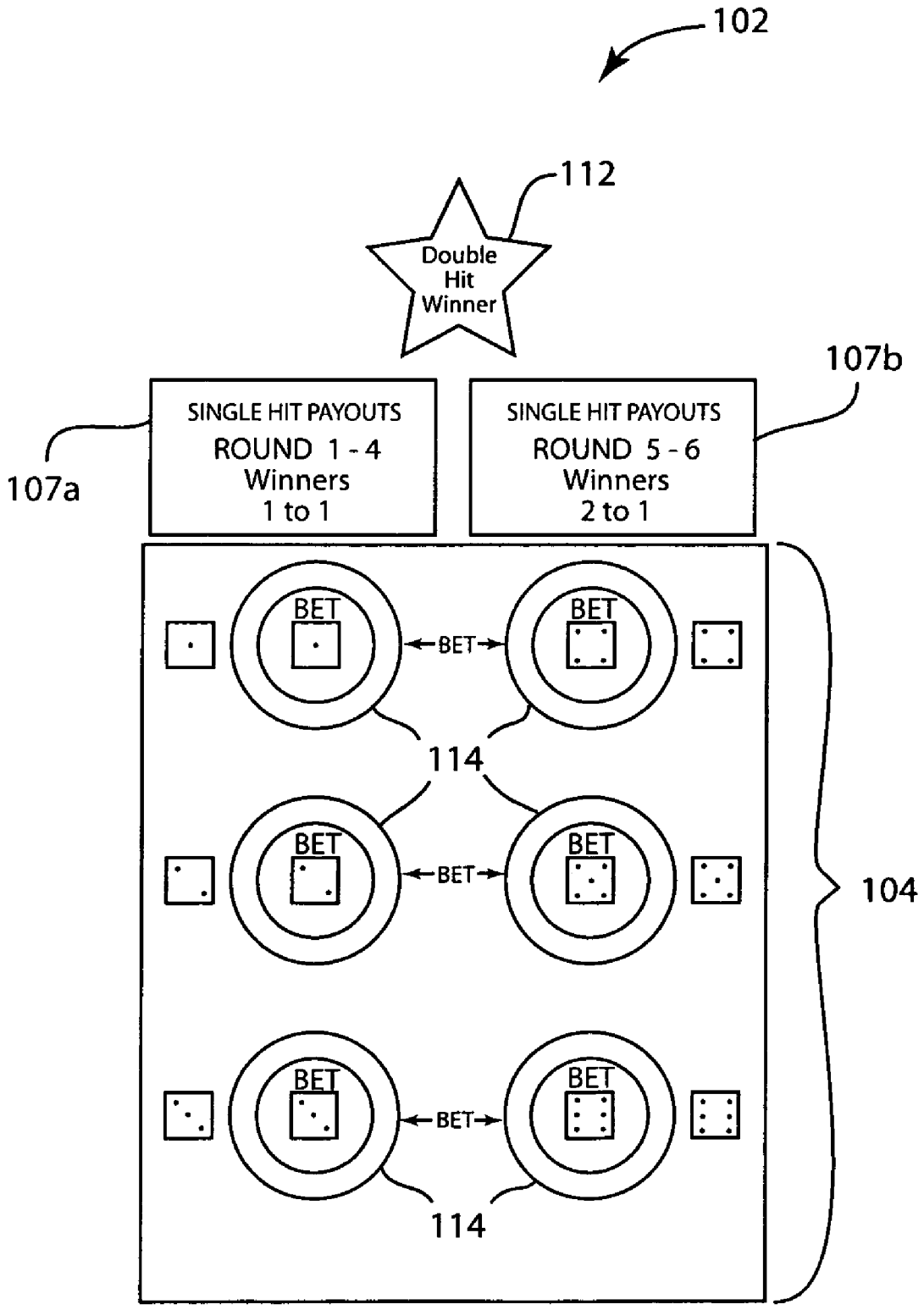
FIG. 2 is an illustration of a player area of an embodiment of the present invention.

In a preferred embodiment, there are seven dice used in the game and one dice cup to shake the dice. There is also a dice marker 110 to keep track of what the dealer's number is in each game. This dice marker 110 can vary depending on the casino. Additional embodiments include a dice marker 110 implemented with a set of flipcards with the numbers 1 through 6 listed on separate cards or an electronic scoreboard where the numbers 1 through 6 will appear, when the dealer enters them on a console. The number that appears in any of these display components will be the dealer's number each game. Referring to FIG. 1 and FIG. 2, there is player area 102 for each individual gambler. Each player area 102 consists of a betting area 104 in which players place their bets on a betting circle 114 numbered 1 through 6 (except on the dealer's number for that game). The remaining area includes the single hit payout area 106, the double hit payout area 108 and the double hit collection area 112. These three sections are for winning wagers. The dealer places the player's wager on the appropriate winning wager section. There are three winning wager sections in the collection area, the 1-4 winners payout area 107*a*, the 5-6 winners payout area 107*b* and the Double Hit collection area 112. Preferably, 7 standard six-sided dice are used in the game, and one of the dice is a different color than the other six. That die is used to determine the dealer's number. The other six game dice are rolled one at a time, one per round, for 6 rounds, to determine if the player or dealer wins. The dice cup is used to roll the dice. In other embodiments, a single game die may be rolled over and over for 6 rounds.

Figure 3:
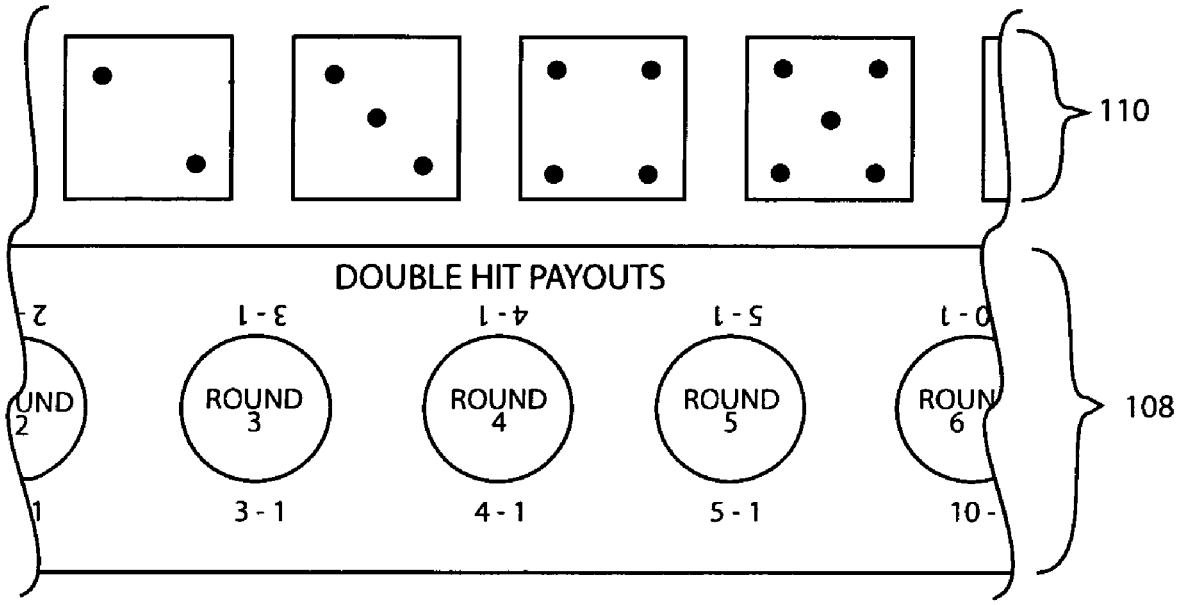
FIG. 3 is an illustration of the Double Hit Payout section of an embodiment of the present invention.

Still referring to FIGS. 1-3, after the dealer rolls the dealer die to determine the dealer's number, the dealer number is posted to the dice marker 100, so players know which number they are not allowed to bet on in that game. Then players place their wagers by placing a casino chip or chips on the appropriate betting circle 114 of the number they would like in the betting area 104. They may place their wager on any number other than the dealer's number (for example, if the dealer's number is 6, the players may wager on 1, 2, 3, 4, or 5). The players are wagering on whether the number they have chosen will be rolled before the dealer's number or before the end of six rounds. After all the wagers are placed, the dealer rolls a single game die. If it is the dealer's number, all wagers lose and the dealer removes all wagers from the table. If it is the player's number, the player has the option of collecting their winnings or playing for a "Double Hit." This option is only available if the game die and the wager number are the same in round one.

If the player chooses to collect, the dealer moves their wager from the betting area 104 to the appropriate collection area, which in round one is the 1-4 winners payout area 107*a*. If the player chooses to play for the Double Hit, the dealer then places a double hit lammer on the player's wager. Alternatively, a separate double hit area may be utilized to designate such a choice.

By choosing Double Hit, the player is wagering that the number that was hit in the first round will be rolled again before the dealer's number or the end of the remaining five rounds. The payoff for the Double Hit is higher than the single hit payoff. If the number rolled in the first round is neither the player's number or the dealer's number, the game goes to round two. The dealer then rolls a second die. Once again, as in round one, if the number rolled is the dealer's number, all remaining wagers in the betting area 104, which include the initial wagers in the betting circles 114 and all wagers having a Double Hit lammer are now considered losers and are removed from the felt 100 by the dealer. If the second game die is the wager number, their winning wager is then moved by the dealer to the appropriate payout area 106, 108. This includes any winning Double Hit wagers that may occur.

In a preferred embodiment, winning Double Hit wagers are moved by the dealer to the Double Hit payout area 108 that matches the round in which the number was rolled in. It should be noted that the player does not have the choice of playing the Double Hit in any round other than round one. If the number rolled is neither a wager number or the dealer's number, play continues to round three. Each round is played the same to a total maximum number of six rounds. In other words, if the number rolled is a wager number, the player wins, if it is the dealer's number, the player loses. If at the end of six rounds, neither the dealer's number nor the player's number has appeared, all remaining wagers are losers.

Still referring to FIGS. 1-3, once a player has won and has had their wager moved to the appropriate payout area 106, 108, they are not eligible to win again on that wager. Also, once a player has won and has had their wager moved to the appropriate payout areas 106, 108, they are at no risk to lose that wager. The payout areas 106, 108 are for wagers that are won and will be paid at the end of that particular game. Once again, the game ends if any of the following occurs: A) the dealer's number is rolled; B) all wagers of all players are now in the payout areas 106, 108, and there are no bets remaining in the betting area 104; or C) six rounds of dice rolling have been completed.

After a game ends, the dealer removes any remaining wagers from the betting area 104, as those remaining wagers are losers, and pays out any wage in the payout areas 106, 108 to the appropriate player at the appropriate odds. In a preferred embodiment, by multiplying the wager by a predetermined factor, payouts are as follows: if a player wins in Rounds 1 through 4, they receive 1-1 payout for a single hit; if a player wins in rounds 5 or 6, they receive 2-1 payout for a single hit; and if the player opts for playing Double Hit in round one instead of collecting, and their number appears again, the payout is based on the round that the number appears again. Double Hit payouts are as follows: Round 2 (wager number hits again), the player receives 2-1 payout; Round 3, pays 3-1; Round 4, pays 4-1; Round 5, pays 5-1; and Round 6, pays 6-1. If neither the wager number or the dealer number appears again within the 6 Rounds, the wager is lost. The variations of the game would be the odds the casino pays off the players for various wagers, depending on the percent advantage the casino wishes to be at. A second variation would be to eliminate the payout areas 106, 108, and pay wagers as they are won.

Preferably, the dice cup is used to roll the dice in. The dice cup is a cylinder to hold the die while the dealer is shaking and rolling the die. The dice cup can be any color, shape, or size. It can also be an automatic dice roller or any other non-dice electrical device for determining the number in each round. The dealer number, as well as the game numbers, can also be generated by a computer and displayed at the table, or applied to an on-line version of the game.

In alternative embodiments, the odds payoff structure can be changed to increase casino profits or increase gamblers winnings. In addition, the table diagram can be changed slightly to make the diagram fit to each casino's tables more conveniently. For example, in the attached FIG. 1, the double hit payout area 108 is included in the player area 102, and the betting area is a single file line of betting circles 114. Still referring to FIG. 1, the dice marker 110 is aligned in front of the dealer, standing alone. Referring now to FIG. 2, the preferred embodiment of the present invention is depicted where the betting area 104 includes two rows of betting circles 114, and the single payout area 106 including the 1-4 winners payout area 107*a* and the 5-6 winners payout area 107*b*, but not the double hit payout area 108. Rather, in FIG. 2, a double hit collection area 112 is included, where a player's winnings from a double hit payout area 108 are placed after the dice game ends. Referring to FIG. 3, a double hit payout area 108 is aligned next to the dice marker 110, and not in each individual player area 102, as depicted in FIG. 1. The double hit payout area 108 and dice marker 110 of FIG. 3 would be implemented in the preferred embodiment with the player area 102 depicted in FIG. 2. Additional embodiments could include a double hit betting area instead of a lammer to mark which wager is a double hit wager.

Additional embodiments include having a progressive pool wager, where players could bet and win if the outcome of each of the dice rolled in the 6 rounds fit a predetermined order. For example, a 3 rolled on the first die, then the second die, the third die, then the fourth die, then the fifth die, and finally the sixth die, would create a "six of a kind", and be a progressive payoff for all those who wagered it, at the table. Other progressive payoffs could be awarded for a straight (e.g., 1-2-3-4-5-6), 5 of a kind, 4 of a kind, full house, or any other predetermined combination of the dice.

Players would wager an additional bet to be eligible for the progressive payoffs. Additional embodiments include changing the number of rounds to alter the payouts, changing the odds, or using shapes, letters or any other symbol on the dice.

Furthermore, additional embodiments include playing the game in an electronic form, such as a video or slot machine, or an online web site. This embodiment includes a computer capable of generating random numbers for the dealer number and the game numbers while a player utilizes an input/output device and a graphical user interface, to interactively play the game online or electronically in a casino, or other location. It could also be played as a homeboard game or a television gameshow format. Players could also be allowed to play for a double hit in any round in which their number is rolled, as opposed to just the first round, and even a Triple Hit option as well as hitting your number four, five or six times.

Additional embodiments include rolling the dice all at once and having colors or another method to identify the round that each die represents, and allowing players to compete against each other, rather than only against the dealer. In this embodiment, an ante is placed at the beginning of the game, as well as an initial bet and the casino would collect the ante as their profit.

The following examples are provided to give one skilled in the art a better understanding of the method and apparatus of the present invention, and should not be construed as defining a preferred embodiment of the present invention. Game Example #1—There are four players A, B, C, and D. The Dealer rolls the dealer die to determine the dealer number for that game. The dealer number is a 5, indicated by the five dots on the die. Players then place their wagers on the betting circles 114 that they feel will be rolled before the dealers number is rolled, or before the end of six rounds. Player A places a wager on 2. Player B places wagers on 1 and 3. Player C places wagers on 2,4 and 6. Player D places wagers on 1,2,3,4, and 6. The Dealer now rolls the first of six dice: it is a 1. Player B collects on his wager of 1 (his wager is moved to the 1-4 winners payout area 107*a*). Player D opts to "Double Hit" on the 1 roll. All other Players have no action. Play moves to round 2. The Dealer now rolls the second of the six dice: it is a 6. Player C and Player D collect on their 6 wager (these wagers are moved to the 1-4 winners payout area 107*a*). All other Players have no action. Play moves to round 3. The Dealer now rolls the third of six dice: it is a 4. Player C collects on his 4 wager (his wager is moved to the 1-4 winners payout area 107*a*). Player D collects on his 4 wager (his wager is moved to the 1-4 winners payout area 107*a*). All other Players have no action. Play moves to round 4. The Dealer now rolls the fourth of six dice: it is a 6. All Players have no action. Play moves to round 5. The Dealer now rolls the fifth of six dice: it is a 1. Player D collects five times his wager on his 1 Double Hit wager (his wager is moved to the Double Hit payout area 108). All other Players have no action. Play moves to round 6. The Dealer now rolls the sixth and last of the six dice: it is a 2. Player A collects on his 2 wager (his wager is moved to the 5-6 winners payout area 107*b*). Player C collects on his 2 wager and his wager is moved to the 5-6 winners payout area 107*b*. Player D collects on his 2 wager (his wager is moved to the 5-6 winners payout area 107*b*). Players B and C lose on their 3 wagers since the number did not come up within the six rounds and the dealer collects their wagers. The Dealer now pays all wagers that are in the payout areas 106, 108, including moving any double hit winnings to the double hit collection area 112, and a new game may begin.

Figure 4:
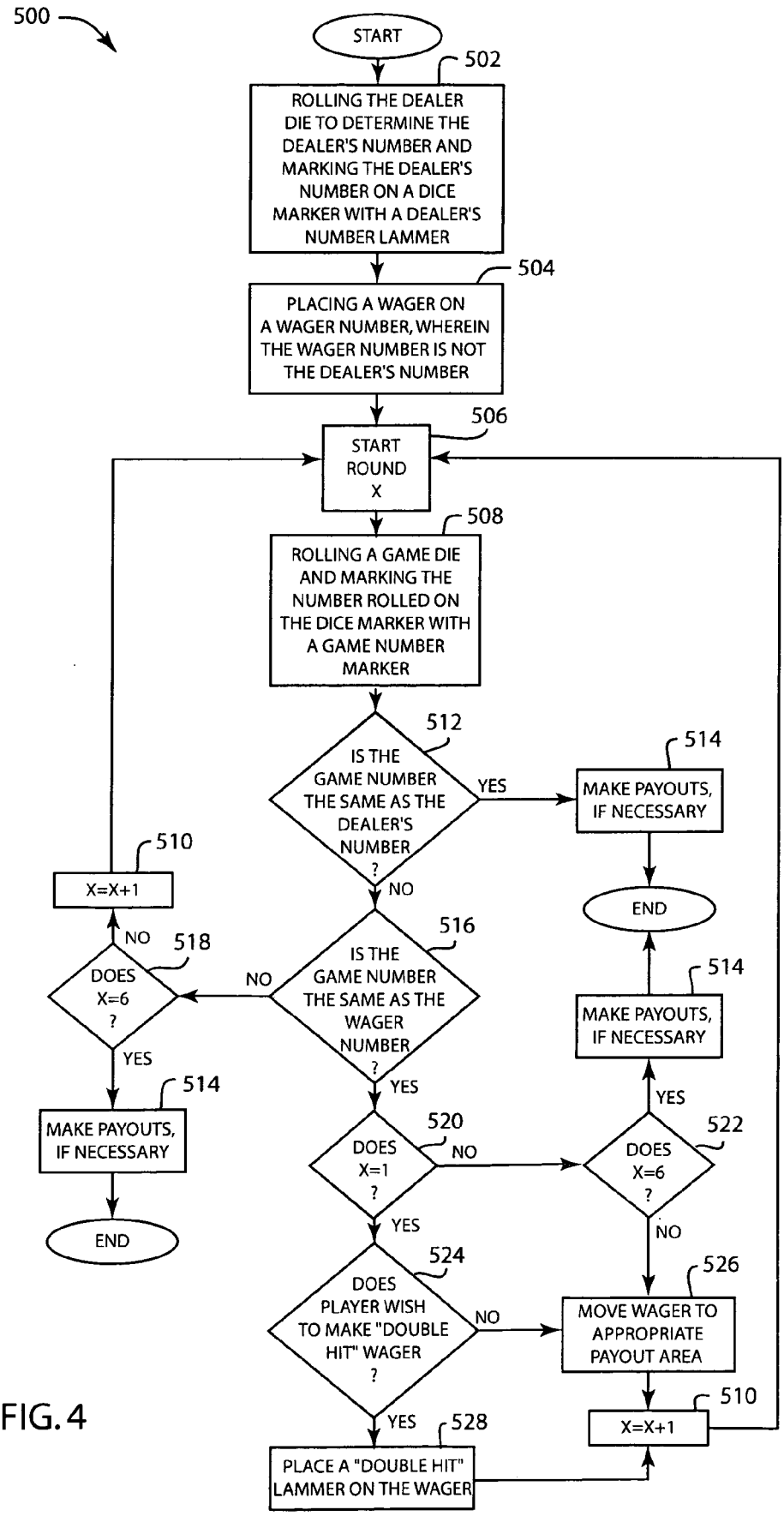
FIG. 4 is a flowchart of a method of an embodiment of the present invention.

Referring now to FIG. 4, a method of the preferred embodiment of the present invention is depicted. The method of playing a dice game 500 begins in step 502 with the dealer rolling the dealer die to determine the dealer's number and marking the dealer's number on a dice marker with a dealer's number lammer. In step 504, players may place wagers on a wager number, wherein the wager number is not the dealer's number. In other words, a player or players may wager on any number in the betting area, except for the number rolled by the dealer in step 502. In step 506, the current round is started, and in step 508 a game die is rolled and the number rolled is marked on the dice marker with a game number lammer. In step 512, if the game number is the same as the dealer number, then any payouts on the board are made in step 514 before the game ends. However, if the game number rolled is not the same as the dealer's number, then in step 516 the game number is compared to the wager number.

Still referring to FIG. 4, if the game number is not the same as the wager number in step 516, then in step 518 if the current round number is Round 6, then any payouts currently on the board are made in step 514 before the game ends. If in step 518, it is determined that the game is not in Round 6, then in step 510, the game proceeds to the next round and that next round is started in step 506. Referring back to step 516, if the game number is the same as the wager number, then the method 500 proceeds to step 520. In step 520, if the game is in Round 1, the player is prompted in step 524 whether the player wishes to make a double hit wager. If the game in step 520 is not in the first round, and in step 522 it is determined that the game is in fact in the sixth round, then any payouts on the game board are made in step 514 and the method ends.

Referring back to step 524, if the player does wish to make a double hit wager, then in step 528, a double hit lammer is placed on the wager, the round of the game is increased by one in step 510, and the new round is started in step 506. If the player does not wish to make a double hit wager in step 524, then the wager is moved to the appropriate payout area in step 526, the game is advanced to the next round in step 510, and the next round is started in step 506. Referring now back to step 522, if the game is not in the sixth round, then the wager is moved to the appropriate payout area in step 526, the round of the game is advanced to the next round in step 510, and the next round is started in step 506.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

It is to be understood that the invention is not limited in its application to the details of construction and to the arrangements of the components set forth in the above description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a simpler and exciting dice game that will overcome the shortcomings of the prior art devices. The present invention embodies a number advantages and improvements over the prior.

One advantage of the present invention is to provide a simpler and exciting dice game for casinos to use to provide an additional game of chance for gamblers, giving the casino a slight statistical edge to generate revenue while at the same time providing gamblers a new dice game which is much easier to learn that craps, has simpler strategy than Blackjack, allows gamblers the opportunity to increase winnings with a unique payoff structure which increases as the game continues, and provides an exciting sit down dice game for gamblers in which each roll increases the excitement.

Another advantage is that the present invention provides a simpler and exciting dice game that casinos can use to allow gamblers to play a dice game which is easy to understand with simple rules and odds payouts, unlike craps which is often intimidating to many players.

The present invention also provides a simpler and exciting dice game that the casino can provide to gamblers in a sit-down setting, so players do not need to stand as is generally done in craps, the primary available dice game.

The present invention provides a simpler and exciting dice game that the casino can offer gamblers to play without concern of players tampering with the dice, because the players never touch the dice, unlike craps where players throw the dice and could gain an unfair advantage by tampering or by their toss. In addition, tampering could also occur in card games such as Let It Ride or Caribbean Stud where player's handle the cards.

The present invention also provides a simpler and exciting dice game that the casino can offer to players that would provide a unique odds payoff structure, in which the odds the player can receive increases as the game goes on, providing greater excitement and the possibility of a player winning more without having to increase their wager.

The present invention also provides a simpler and exciting dice game that the casino can use to increase the number of betting spots on a table game, so each player is not limited to only one wager as in Blackjack or Caribbean Stud. It provides a simpler and exciting dice game that a casino can provide to players to give them a game to play where a player can play his wagers and not feel like they are being judged on their strategy by other players at the table, which often happens at Blackjack. In other words, a gamblers play does not affect the outcome of others at the table. It also provides a simpler and exciting dice game that the casino can provide to gamblers in which the casino can have a percentage advantage to increase their revenues and yet, provide the players an exciting game in which players can win large sums of money as well.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated.

We claim:

1. A method for playing a dice game, the method comprising:

a) determining a dealer's number by rolling a dealer's die;

b) placing a wager on a wager number, wherein the wager number is selected from one of the numbers on a game die, further wherein the wager number is not the same as the dealer's number;

c) determining a first game number by rolling a game die;

d) comparing the first game number to the wager number, wherein when the first game number is the same as the wager number, the player wins a single hit payout, the single hit payout including the wager multiplied by a predetermined single hit factor, and further wherein when the dice game is in a first round, the player is given a choice between collecting the single hit payout or making a double hit wager;

e) determining a second game number by rolling the game die, wherein when the second game number is the same as the wager number, the player wins the single hit payout, further wherein when the player chooses to make the double hit wager and the second game number is the same as the wager number, the player wins a double hit payout, the double hit payout including the wager multiplied by a predetermined double hit factor; and f) comparing the first game number and the second game number to the dealer number, wherein when either one of the first game number or second game number is the same as the dealer number, the dice game ends, wherein the dice game includes a predetermined number of rounds including a corresponding number of potential game numbers, further wherein the dice game ends after the predetermined number of rounds.

2. The method as claimed in claim 1, further comprising:

a) marking the dealer's number on a dice marker with a dealer's number lammer;

b) marking the first game number on the dice marker with a game number lammer; and c) marking the second game number on the dice marker with the game number lammer.

3. The method as claimed in claim 1, further comprising placing the single hit payout in a single hit payout area, wherein the single hit payout is collected by the player when the dice game ends.

4. The method as claimed in claim 1, further comprising placing a double hit wager lammer on the wager when the player chooses to make the double hit wager.

5. The method as claimed in claim 1, further comprising placing the double hit payout in a double hit payout area, wherein the double hit payout is collected by the player when the dice game ends.

6. The method as claimed in claim 1, wherein the single hit factor and the double hit factor are variable values that depend on which one of the predetermined number of rounds is currently being played.

* * * * *